US006167954B1

(12) United States Patent
Martins

(10) Patent No.: US 6,167,954 B1
(45) Date of Patent: Jan. 2, 2001

(54) HEAT EXCHANGER WITH FLEXIBLE TUBES, ESPECIALLY FOR A MOTOR VEHICLE

(75) Inventor: Carlos Martins, Montfort l'Amaury (FR)

(73) Assignee: Valeo Thermique Moteur, La Verriere (FR)

( * ) Notice: Under 35 U.S.C. 154(b), the term of this patent shall be extended for 0 days.

(21) Appl. No.: 09/558,559

(22) Filed: Apr. 26, 2000

(30) Foreign Application Priority Data

Apr. 29, 1999 (FR) ..... 99 05461

(51) Int. Cl.[7] ..... F28F 9/02
(52) U.S. Cl. ..... 165/175; 165/148; 165/153
(58) Field of Search ..... 165/148, 173, 165/175, 176, 153, 906

(56) References Cited

U.S. PATENT DOCUMENTS

| | | | | |
|---|---|---|---|---|
| 711,769 | * | 10/1902 | Hussey | 165/175 |
| 857,060 | * | 6/1907 | Heizmann | 165/176 |
| 2,176,406 | * | 10/1939 | McCullough | 165/148 |
| 2,198,529 | * | 4/1940 | Fields | 165/148 |
| 2,587,720 | * | 3/1952 | Fritzberg | 165/176 |
| 2,828,948 | * | 4/1958 | Caldwell, Jr. et al. | 165/176 |
| 3,112,793 | * | 12/1963 | Sass | 165/176 |
| 4,832,119 | * | 5/1989 | Bloor et al. | 165/173 |
| 4,901,792 | * | 2/1990 | Komiya | 165/175 |
| 5,540,278 | * | 7/1996 | Chilba et al. | 165/173 |
| 5,649,588 | * | 7/1997 | Lee | 165/173 |
| 5,690,166 | * | 11/1997 | Yamaguchi | 165/176 |

FOREIGN PATENT DOCUMENTS

| | | |
|---|---|---|
| 196 24 937 | 2/1998 | (DE) . |
| 196 47 189 | 8/1998 | (DE) . |

* cited by examiner

*Primary Examiner*—Ira S. Lazarus
*Assistant Examiner*—Terrell McKinnon
(74) *Attorney, Agent, or Firm*—Morgan &Finnegan LLP

(57) ABSTRACT

A heat exchanger for motor-vehicle equipment, has tubes (1) for a heat-exchange fluid and produced from a flexible material, as well as two parallel manifold plates (2*a,* 2*b*) with apertures (3*a,* 3*b*) for the extremities of each tube (1). These apertures (3*a,* 3*b*) are configured into parallel rows (rk, ri, rj) to form a bundle of rows of parallel tubes. The successive rows of one of the plates (2*a*) are offset alternately in a first direction, parallel to the rows, then in a second direction opposite to this first direction. The rows of the other plate (2*b*) are respectively offset in the second direction, then in the first direction, in such a way that the tubes of two consecutive rows cross over between the two manifold plates (2*a,* 2*b*). Moreover two successive rows of the same plate (2*a*) are spaced by an interstice (d) close to one tube thickness, in such a way that the tubes of two consecutive rows, in crossing over, are in contact (C).

8 Claims, 1 Drawing Sheet

HEAT EXCHANGER WITH FLEXIBLE TUBES, ESPECIALLY FOR A MOTOR VEHICLE

FIELD OF THE INVENTION

The invention relates to a heat exchanger, especially for air-cooling equipment of a motor vehicle. It relates more particularly to a heat exchanger equipped with tubes for conveying a heat-exchange fluid, these tubes being produced from a flexible substance.

BACKGROUND OF THE INVENTION

Such heat exchangers usually include two manifold boxes for the abovementioned heat-exchange fluid. Each of the boxes includes a manifold plate, generally secured leak-tightly to the box. The two manifold plates include apertures for respectively housing the extremities of each tube leak-tightly.

In heat exchangers of the abovementioned type, the apertures of the plates are configured into substantially parallel rows in order to form a bundle of rows of substantially parallel tubes. Such an arrangement of the tubes advantageously allows satisfactory heat exchange between the tubes and a fluid passing through the exchanger.

However, having regard to the flexible structure of the tubes, it is necessary to hold them, at least in the same row, spaced appreciably away from each other.

One solution would consist in providing spacer elements between the tubes, in order to keep them spaced apart. However, such spacing means contribute to adding excess stages to the method of manufacturing such an exchanger, as well as adding to the number of components to be provided.

The present invention aims to improve the situation.

SUMMARY OF THE INVENTION

According to a the present invention there is provided a heat exchanger, specially adapted for motor-vehicle equipment, of the type comprising a plurality of tubes intended to convey a heat-exchange fluid and produced from a flexible material, as well as two substantially parallel manifold plates comprising apertures for respectively housing the extremities of each tube, while the said apertures are configured into substantially parallel rows in order to form a bundle of rows of substantially parallel tubes, wherein the successive rows of one of the plates are offset alternately in a first direction, substantially parallel to the rows, then in a second direction substantially opposite to the said first direction, while the rows of the other plate are respectively offset in the second direction, then in the first direction, in such a way that the tubes of two consecutive rows cross over between the two manifold plates, and wherein two successive rows of the same plate are spaced by an interstice essentially close to one tube thickness, in such a way that the tubes of two consecutive rows, in crossing over, are substantially in contact.

Hence, the tubes of the heat exchanger according to the invention are in contact only at one or two substantially point-like areas, and remain spaced apart from one another outside these point-like areas.

Advantageously, two consecutive apertures of the same row are spaced substantially by a predetermined pitch, which amounts to arranging the tubes of the same row substantially spaced apart from one another.

This predetermined pitch is preferably less than two and a half times the diameter of a tube.

According to another advantageous characteristic of the invention, the tubes, at least in a part comprising their areas of mutual contact, include outer walls coated with a layer of adhesive in order to form means for holding the tubes.

In one preferred embodiment of the heat exchanger according to the invention, the outer walls of the tubes carry a material which is made adhesive by a heat treatment.

BRIEF DESCRIPTION OF THE DRAWINGS

Other characteristics and advantages of the invention will emerge on examining the detailed description below, and the attached drawings in which.

DESCRIPTION OF THE PREFERRED EMBODIMENT

Figure 1:
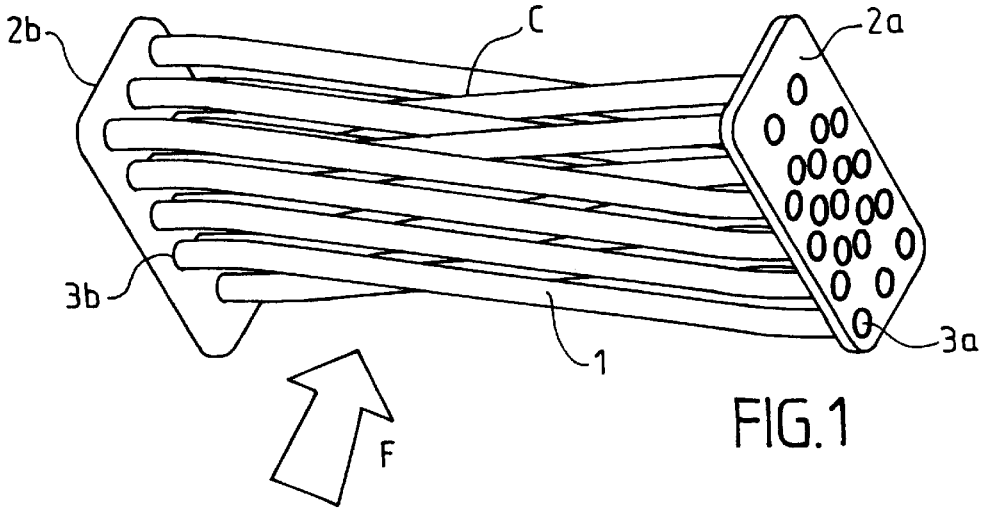
FIG. 1 is a partial view of a heat exchanger according to the invention.

In the various figures, like reference numerals refer to like parts.

The drawings essentially contain elements of a certain character. They could therefore not only serve for better understanding of the invention, but also contribute to the definition of the invention, as the case may be.

Reference is made first of all to FIG. 1 in order to describe a heat exchanger equipped with flexible tubes, which is intended for use as a radiator for cooling supercharging air of a motor vehicle, in the example described. More particularly, such a heat exchanger contributes to the cooling of the supercharging air for an internal-combustion engine of a motor vehicle, in particular of a heavy goods vehicle.

The supercharging of an internal-combustion engine consists in feeding this engine with compressed air, and not directly with atmospheric air, which makes it possible to increase the mass of oxygen available in the combustion chambers. The compressing of the air is accompanied by a strong rise in temperature, and it is then necessary to cool this air.

Figure 2:
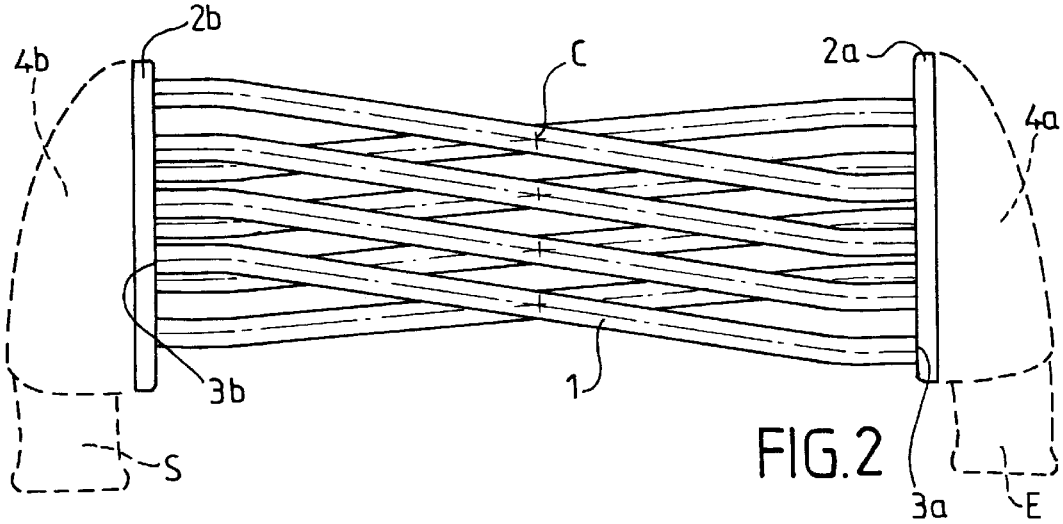
FIG. 2 is a front view of the exchanger represented in FIG. 1.

Referring in particular to FIG. 2, such a heat exchanger includes two manifold boxes 4*a* and 4*b* (represented in dashed lines), equipped respectively with entry pipes E and with exit pipes S for a refrigerant fluid (for example a cooling liquid), intended to be conveyed by a bundle of tubes 1 which is intended to interact by heat exchange with an airflow (F) which passes through the heat exchanger, with a view to cooling this airflow F.

Each manifold box 4*a,* 4*b* comprises a manifold plate 2*a,* 2*b* comprising apertures 3*a,* 3*b* for housing, substantially leaktightly, the respective extremities of each tube 1. Generally, each manifold plate 2*a,* 2*b* is integral, leaktightly, with a shell which the manifold box 4*a,* 4*b* includes.

Figure 3:
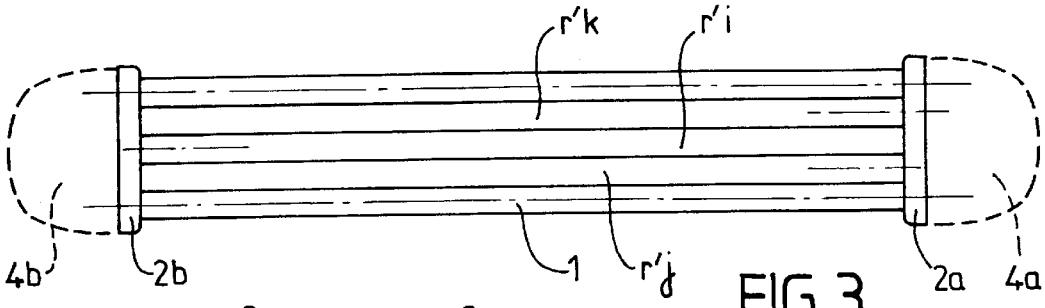
FIG. 3 is a top view of the exchanger represented in FIG. 1.
Figure 4:
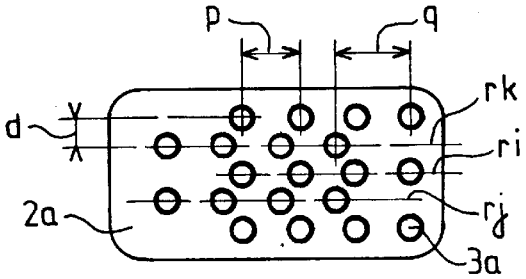
FIG. 4 is a front view of a manifold plate of a heat exchanger according to the invention.

Referring to FIG. 4, the apertures 3*a* of each manifold plate 2*a* are configured into parallel rows rk, ri, rj (horizontal in the example represented). Such a configuration over each of the plates 2*a* and 2*b* defines a general arrangement of the tubes 1 into a bundle of parallel rows r'k, r'i, r'j (FIG. 3).

According to the invention, the successive rows rk, ri, rj of the apertures of a plate 2*a,* are offset alternately in a first direction (horizontal in the example represented), then in a second opposite direction. Furthermore, the corresponding rows (not represented) of the other manifold plate 2*b* are offset respectively in the second opposite direction, then in the first abovementioned direction.

The respective shapes of the two manifold plates 2*a* and 2*b* are preferably deduced substantially from one another by rotation by 180° about an axis perpendicular to the plates (axis perpendicular to the plane of FIG. 4). Hence, in the example represented in FIG. 4, the row ri is offset to the right with respect to the consecutive row rk by a distance q, while the corresponding rows (coinciding with the same rows of tubes r'k and r'i) of the other manifold plate 2*b* are offset to the left, by the same distance q. Furthermore, the two rows ri and rj of the plate 2*a* are offset to the left, by the same distance q, while the corresponding rows of the plate 2*b* are offset to the right by this distance q, this being done alternately.

The alternate offsets of the rows rk, ri, rj of the plates 2*a* and 2*b* thus define a structure of the tubes 1 according to which the tubes of two consecutive rows r'i and r'j cross over in a region C (FIGS. 1 and 2) situated between the two manifold plates 2*a* and 2*b*.

Two successive rows of apertures ri and rj are spaced apart by a distance d (in a vertical direction) essentially close to one tube diameter (of substantially circular cross-section in the example described) in such a way that the tubes of two consecutive rows are in contact in the crossover area C situated between the two manifold plates 2*a* and 2*b*. In particular, the tubes of an intermediate row r'i (situated neither at the start nor at the end of the stack) comprise two contact regions, with the tubes of an upper row r'k and with the tubes of a lower row r'j.

Advantageously, the outer surfaces of the tubes 1 are coated with a film which is made adhesive by heat treatment, which makes it possible to make the shaped bundle of tubes rigid, while keeping the tubes spaced apart outside of their contact area C.

The tubes of the same row r'i are preferably spaced apart by a distance which defines the pitch p between the apertures of the same row ri on the manifold plates (FIG. 4). This pitch p is less than or of the order of two and a half times the diameter d of the tube ($p=2.5\times d$). Such a distance separating the tubes of the same row advantageously makes it possible to obtain optimal cooperation between the tubes and the airflow F (typically an efficiency, in terms of thermal efficacy, close to 90%).

Needless to say, the present invention is not limited to the embodiment described above by way of example. It extends to other variants.

Hence it will be understood that the tubes 1 may include only one or two points of adhesive (one point of adhesive for the end rows and two points of adhesive for the intermediate rows), in their contact areas C.

In the example represented in FIG. 4, the pitch p between two tubes of the same row, constant in the example, is close to a distance equivalent to 2.5 times the diameter of a tube. In a variant, this pitch p may be different, preferably less than this distance.

In the example described above, the two manifold plates 2*a* and 2*b* have respective shapes which are deduced from one another by a rotation of 180° about the axis perpendicular to the plates. In a variant, the respective shapes of the plates may be different. For example, the pitch p between the apertures of the same row may be different from one plate to the other, or else the offset q between two successive rows may be different.

Finally, the use of a heat exchanger according to the invention as a radiator for cooling supercharging air of a motor vehicle is, although particularly advantageous, described above by way of example. In a general way, such an exchanger can be used as a radiator for cooling a vehicle engine, a heating radiator in a ventilation, heating and/or air conditioning installation of this vehicle, or otherwise.

What is claimed is:

1. A heat exchanger, specially adapted for motor-vehicle equipment, of the type comprising a plurality of tubes intended to convey a heat-exchange fluid and produced from a flexible material, as well as two substantially parallel manifold plates comprising apertures for respectively housing the extremities of each tube, while the said apertures are configured into substantially parallel rows in order to form a bundle of rows of substantially parallel tubes, wherein the successive rows of one of the plates are offset alternately in a first direction, substantially parallel to the rows, then in a second direction substantially opposite to the said first direction, while the rows of the other plate are respectively offset in the second direction, then in the first direction, in such a way that the tubes of two consecutive rows cross over between the two manifold plates, and wherein two successive rows of the same plate are spaced by an interstice essentially close to one tube thickness, in such a way that the tubes of two consecutive rows, in crossing over, are substantially in contact.

2. The heat exchanger of claim 1, wherein two consecutive apertures of the same row are spaced substantially by a predetermined pitch.

3. The heat exchanger of claim 2, wherein the predetermined pitch is less than two and a half times the diameter of a tube.

4. The heat exchanger of claim 1, wherein the tubes, at least partly comprising an area of mutual contact, include outer walls coated with a layer of adhesive in order to form means for holding the tubes.

5. The heat exchanger of claim 4, wherein the outer walls of the tubes carry a material which is made adhesive by a heat treatment.

6. The heat exchanger of claim 1 wherein the two manifold plates have respective shapes being deduced substantially from one another by rotation by 180° about an axis perpendicular to the plates.

7. The heat exchanger of claim 1 wherein the manifold plates are each integral, substantially leaktightly, with a manifold box for the said heat-exchange fluid.

8. The heat exchanger of claim 1, adapted to operate as a radiator for cooling supercharging air of a motor vehicle.

* * * * *